US006592446B1

(12) United States Patent
Zimmermann

(10) Patent No.: US 6,592,446 B1
(45) Date of Patent: Jul. 15, 2003

(54) DEVICE FOR CONVEYING SEPARATE OBJECTS, ESPECIALLY COINS

(75) Inventor: Thomas Zimmermann, Berlin (DE)

(73) Assignee: F. Zimmermann GmbH & Co. KG (DE)

( * ) Notice: Subject to any disclaimer, the term of this patent is extended or adjusted under 35 U.S.C. 154(b) by 27 days.

(21) Appl. No.: 09/721,149

(22) Filed: Nov. 22, 2000

(30) Foreign Application Priority Data

Nov. 23, 1999 (DE) ..... 199 57 482

(51) Int. Cl.[7] ..... G07D 1/00
(52) U.S. Cl. ..... 453/56; 198/699.1; 209/917
(58) Field of Search ..... 209/917; 453/56; 194/342; 198/688.1, 690.2, 697, 698, 699, 699.1, 803.8, 844.1

(56) References Cited

FOREIGN PATENT DOCUMENTS

| | | |
|---|---|---|
| DE | DIN 53505 | 8/2000 |
| EP | 0616303 B1 | 1/1998 |

OTHER PUBLICATIONS

*Förderbandkonstruktion fur Spezialzwecke. Spurzahnbänder Dec. 1995.*

*Primary Examiner*—Donald P. Walsh
*Assistant Examiner*—Mark J. Beauchaine
(74) *Attorney, Agent, or Firm*—McGlew and Tuttle, P.C.

(57) ABSTRACT

A device for conveying separate objects (1), especially disk-shaped objects such as coins is provided with a guideway (2) and with a conveyor (4) running on a conveying arm (3) at a distance from the guideway (2). The distance (d) between a strand (5) of the transport belt (4) facing the guideway and the guideway (2) is smaller than the smallest height of an object (1) above the guideway (2). The objects (1) can be grasped by the strand (5) of the conveyor (4) facing the guideway (2) and can be conveyed on the guideway (2) and wherein the static friction and/or sliding friction forces between the objects (1) and he conveyor (4) are greater than the static friction and/or sliding friction forces between the objects (1) and the guideway (2). The conveyor (4) is a lamella belt (4) and the strand (5) of the lamella belt (4) facing the guideway (2) is guided over the entire longitudinal extension of the conveying arm (3). The distance (d') between lamella tips (6) pointing toward the guideway (2) and the guideway (2) is smaller than the smallest height of an object (1) above the guideway (2).

19 Claims, 4 Drawing Sheets

DEVICE FOR CONVEYING SEPARATE OBJECTS, ESPECIALLY COINS

FIELD OF THE INVENTION

The present invention pertains to a device for conveying separate objects, especially disk-shaped objects, such as coins, with a guideway and with a conveyor circulating on a conveying arm at a spaced location from the guideway, wherein the distance between a strand of the transport belt facing the guideway and the guideway is smaller than the smallest height of an object above the guideway, wherein the objects can be grasped by the strand of the conveyor facing the guideway and can be conveyed on the guideway and wherein the static friction and/or sliding friction forces between the objects and the conveyor are greater than the static friction and/or sliding friction forces between the objects and the guideway, as well as to applications of such a device. The objects that can be conveyed within the framework of the present invention usually have a disk shape, wherein one principal surface slides on the guideway and the opposite principal surface is grasped by the conveyor. A guideway may be designed, e.g., as a sorting plate.

BACKGROUND OF THE INVENTION

A device of the design described in the introduction has been known, e.g., from the reference EP 0 616 303 B1 for conveying coins. The side of the transport belt facing the coins has a smooth surface here, at any rate without readily visible elevations. The pressure of the transport belt on the coins to be conveyed is applied by a plurality of support rollers which are subject to a spring force in the direction of the guideway and which are arranged along the conveying arm. Even though this design has proved basically successful, it has a plurality of drawbacks. It can be pointed out at first that the effort needed for mounting the conveying arm as well as the effort needed for adjusting the individual rollers are considerable. It is disturbing from a kinematic viewpoint that the pressure of the transport belt declines in the areas between the support rollers, which may be disturbing especially during the conveying of coins with greatly varying thicknesses in the case of the thin coins. Furthermore, the prior-art arrangement is also complex from a dynamic viewpoint because of the many spring-loaded support rollers, because a system with pronounced natural frequencies is thus created, which may lead to problems in light of the usual high conveying velocities. To avoid disturbing vibrations of the transport belt against the guideway, certain conveying velocities are therefore to be avoided or suitable damping measures are to be taken. Finally, it is disturbing that the springs of the support rollers may fatigue during long operation times, with the consequence that reliable conveying of even very thin coins is not always guaranteed.

SUMMARY AND OBJECTS OF THE INVENTION

In contrast, the basic technical object of the present invention is to provide a device for conveying separate objects which can be manufactured in a simple manner in terms of mounting and nevertheless guarantees the reliable conveying of objects of different thicknesses and it does so even during long operation times.

To accomplish this technical object, the present invention teaches that the conveyor is a lamella belt and that the strand of the lamella belt facing the guideway is guided over the entire longitudinal extension of the convening arm with the proviso that the distance d' between the lamella tips pointing toward the guideway and the guideway is smaller than the smallest height of an object above the guideway.—A transport belt which has a continuous, especially uniform sequence of vertically or obliquely projecting lamellae on its side running against the guideway, which lamellae are arranged at a belt base, is called a lamella belt. The terms "lamella belt" and "lamella" also cover within the framework of the present invention embodiments with knobs, e.g., of a cylindrical design, arranged regularly or irregularly, laterally (or at right angles to the longitudinal extension of the belt). The lamellae may be oblique against the direction of conveying or in the direction of conveying. The form of the lamellae is basically freely selectable. Centrally symmetrical lamellae with a triangular cross section (relative to a plane arranged at right angles to the guideway and extending in the direction of conveying) are preferred, the tips of the lamellae being rounded. The lamellae may extend at right angles to the direction of conveying in their extension at right angles to the direction of conveying (continuously) or may be set at a pitch angle in relation to the direction of conveying (in the case of the knobs, knob rows may be arranged at right angles or with a pitch angle). The latter arrangement, i.e., with a pitch angle, is advantageous, e.g., when the objects are to move on the guideway along a guide edge. In this case, the pitch angle, measured between the longitudinal extension of the transport belt and the transverse extension of the lamellae, namely, on the side in the direction of movement of the transport belt, is smaller than 90°, e.g., between 80° and 89.5°. The term "lamella" implies within the framework of the present invention that these are rubber-elastic or elastic. The distance d' can be selected in a range from 0 to a value slightly below the thinnest object to be conveyed. A range of 0 to 1 mm, preferably 0 to 0.5 mm and especially 0 to 0.1 mm is recommended for d' in the case of coins.

Objects with very greatly varying thicknesses can be surprisingly conveyed with the present invention with very high reliability. Without wanting to be bound to a theory, the reason for this is presumably, especially in the case of thin objects, an effect supporting the conveying during the coming into contact of a lamella with an edge of an object standing opposite the direction of conveying. This object is now conveyed not only because of the friction effects of lamellae that are in contact, but the object is additionally quasi pushed. Furthermore, the use of a lamella belt according to the present invention makes it unnecessary to arrange a plurality of support rollers, which must press the smooth belt against the objects according to the state of the art, doing so with corresponding spring excursions in the case of varying thicknesses. Finally, the risk of fatiguing of the springs is therefore eliminated as well. It is also particularly advantageous that the present invention is suitable not only for horizontal conveying, but also for oblique and vertical conveying. Consequently, the longitudinal extension of the guideway may form any desirable angle with the horizontal direction. In particular, the angle between the guideway and the horizontal direction may be variable and preferably continuously variable over the course of the guideway. Consequently, curved guideways are also possible, besides flat guideways.

A preferred embodiment of the present invention is characterized in that at least the lamellae of the lamella belt, preferably the lamella belt as a whole (optionally with reinforcing inserts) is made of a material which is selected from the group comprising "elastomers, rubbers, natural rubber, synthetic rubber, polyurethane, polyether polyurethane, polyester polyurethane, rubber-elastic materials and mixtures of these materials." These lamella materials possess advantageous properties in terms of their rubber-elastic material properties as well as the friction forces occurring between the material and the objects. It is preferred in these connections for the lamellae to have a Shore A hardness of 50 to 100 and preferably 60 to 80 measured according to DIN 53505 (version: June 1987).

Concerning the geometric design, it is preferable for the height of the lamellae to be in the range of 2 to 20 mm, preferably 2 to 8 mm and especially 3 to 5 mm. The measure from a lamella base at the belt base to the tip of the lamella is called the height of the lamella. The density of the lamellae is preferably in the range of 100/100 mm to 10/100 mm and preferably 50/100 mm to 20/100 mm. The number of lamellae per 100 mm of lamella belt in its longitudinal extension or its unrolled circumference is called the lamella density. This also applies analogously to the knobs.

The lamella belt may be designed, in principle, as a V-belt which is structureless on its back side or as a flat belt. However, the lamella belt preferably has drive teeth opposite the lamellae, i.e., on the inside. In this case, the belt can be driven without slip by means of a toothed belt pulley with pulley teeth meshing the drive teeth.

For reasons of preventing disturbing stretching of the lamella belt, the lamella belt may have an endless steel wire insert. Instead of steel wire, reinforcement with other materials, e.g., woven threads or cords, may be provided as well. A wire or thread which extends helically over more than one full circumference of the lamella belt, preferably over at least 2 to 20 times and, e.g., 5 to 15 times the circumference is called "endless." It is obvious that two ends are ultimately left in this case as well, but they are separated from one another by a plurality of endless turns.

Due to the elimination of the need for support rollers, the conveying arm may have a comparatively simple design. The conveying arm preferably has at least one guide element, which has a U- or H-shaped cross section in the longitudinal extension of the conveying arm, wherein the lamella belt is guided by webs on both sides laterally, relative to the lamella belt, and wherein the lamella belt slides on a support surface between the webs. In the case of the U-shaped cross section, the webs are, of course, arranged on the side facing the guideway. The lamella belt now runs without lateral guiding, e.g., freely swinging, on the opposite side of the conveying arm. The guide element consists, at least in the area of the support surface, preferably also in the areas of the webs, and everywhere for simplicity's sake, of a material which is selected from the above-mentioned group of materials. The conveying arm preferably has deflecting rollers, preferably spur wheel-shaped deflecting rollers, at its end, with at least one of the deflecting rollers being able to be driven. Such rollers are also called toothed belt pulleys. It is specifically recommended that the support surface have a wedge-shaped inlet area on the inlet side. The conveying arm may have a base carrier on which the one guide element or a plurality of guide elements are arranged adjustably preferably at right angles to the guideway. Reliable setting and maintenance of the distance d' over the entire longitudinal extension of the guide elements is thus guaranteed. Moreover, readjustment is easily possible in the case of worn lamella tips. Furthermore, it is recommended that at least one deflecting roller be able to be adjusted and fixed in the direction of the longitudinal extension of the conveying arm, as a result of which adjustment of the tension of the lamella belt is possible. In addition, the lamella belt can then be easily released to the extent that it can be easily pulled off from the conveying arm.

To ensure easy access to the guideway as well as accessibility for adjusting the guide elements as well as for changing the lamella belt, the conveying arm may be designed such that it can be pivoted off from the guideway on one side. In addition or as an alternative, the conveying arm as a whole may, of course, also be designed as a detachable conveying arm.

The conveying arm may have at least one adjusting element for setting the distance d', as a result of which it is not necessary to readjust all guide elements individually after the adjustment of a plurality of guide elements, e.g., for readjustment or for changeover.

The present invention also provides for the use of a device according to the present invention for conveying coins in the horizontal and/or vertical and/or oblique direction, optionally with, e.g., segment-shaped transition areas.

The device according to the present invention may be used, in particular, in a device for counting and/or sorting coins. Reference is made in this connection to the relevant state of the art insofar as transport belts are used there. These transport belts and the conveying arms belonging to them can be easily replaced with devices according to the present invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
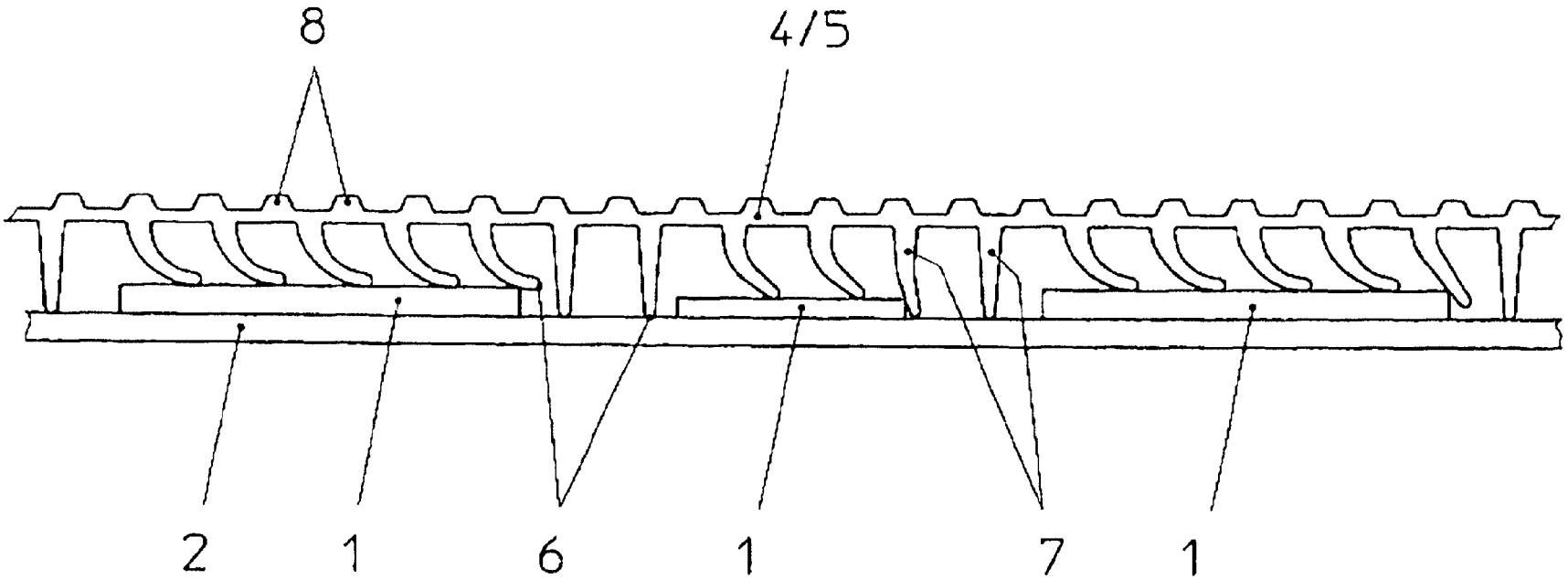
FIG. 1 is a schematic partial view of a feature according to the present invention.

Referring to the drawings in particular, FIG. 1 shows a partial view of a device for conveying separate coins 1, with a guideway 2 and with a conveyor 4 running on a conveying arm 3 at a distance d' from the guideway 2. The distance d' is the distance between a strand 5 of the transport belt 4 facing the guideway and is smaller than the smallest height of an object 1 above the guideway 2. The coins 1 can be grasped by the strand 5 of the transport belt 4 facing the guideway 2 and can be conveyed on the guideway 2 (from right to left in FIG. 1). The static friction and/or sliding friction forces between the objects 1 and the conveyor 4 are greater than the static friction and/or sliding friction forces between the objects 1 and the guideway 2.

The conveyor 4 is specifically a lamella belt 4, and the strand 5 of the lamella belt 4 facing the guideway 2 is guided over the entire longitudinal extension of the conveying arm 3 with the proviso that the distance d' between the lamella tips 6 pointing toward the guideway 2 and the guideway 2 is smaller than the smallest height of an object 1 above the guideway 2. Reference is additionally made in this connection to a comparative viewing of FIGS. 1 and 3. The longitudinal extension of the guideway 2 extends in the horizontal direction in the exemplary embodiment. It can be recognized from FIG. 3 that the coins 1 move along a guide edge 17.

The lamella belt 4 as a whole is made of a rubber-elastic plastic, polyether urethane. The height of the lamella is approx. 3 mm. The lamella density is approx. 25/100 mm. The lamellae 7 have a Shore A hardness of 70 measured according to DIN 53505 (version: June 1987).

Figure 3:
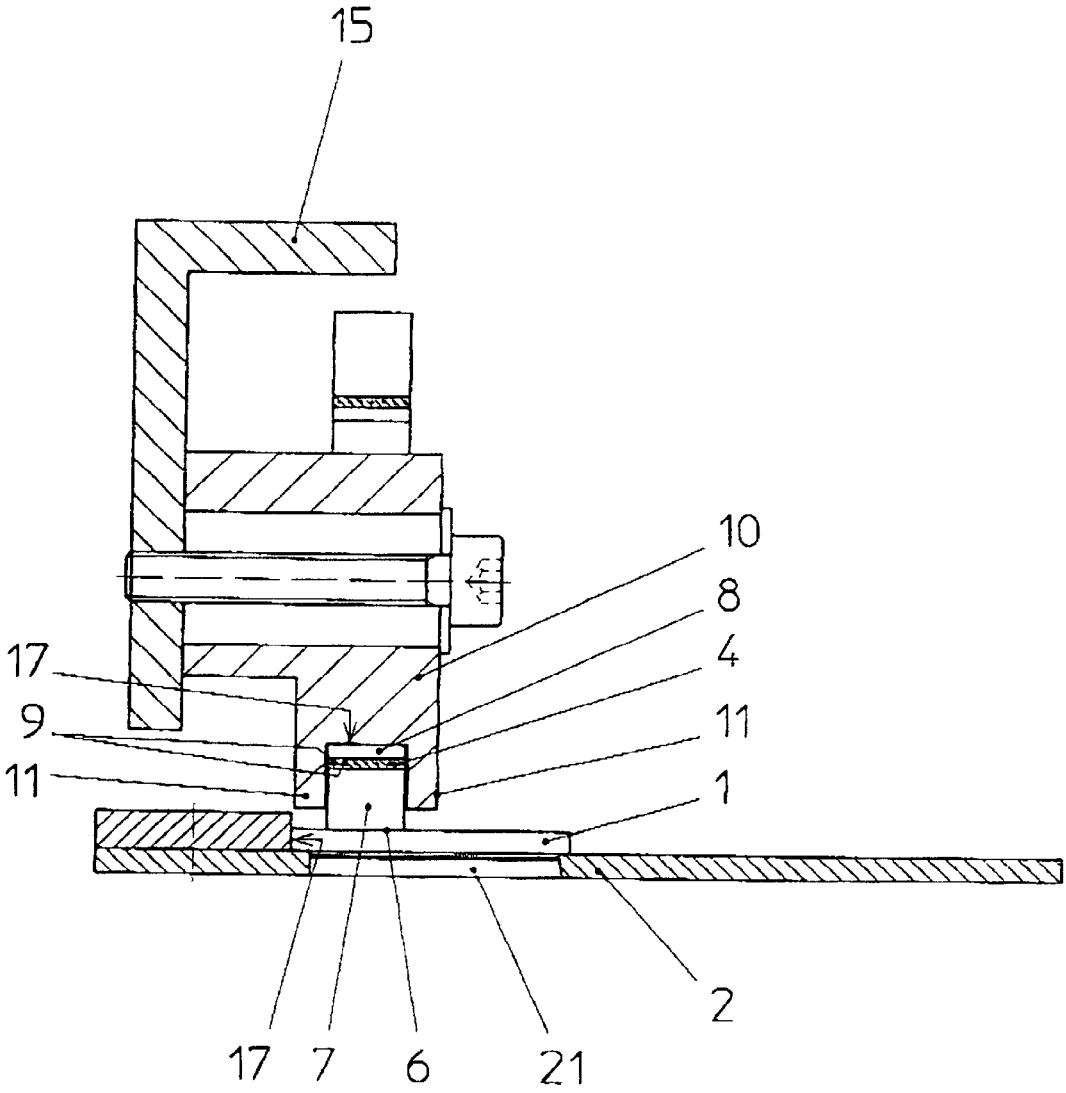
FIG. 3 is a cross section through a device according to the present invention.

It can be clearly recognized especially from FIG. 1 that the lamella belt 4 has drive teeth 8 opposite the lamellae 7. FIG. 3 shows that the lamella belt 4 has an endless steel wire insert 9 consisting of spirals located next to one another.

Figure 2:
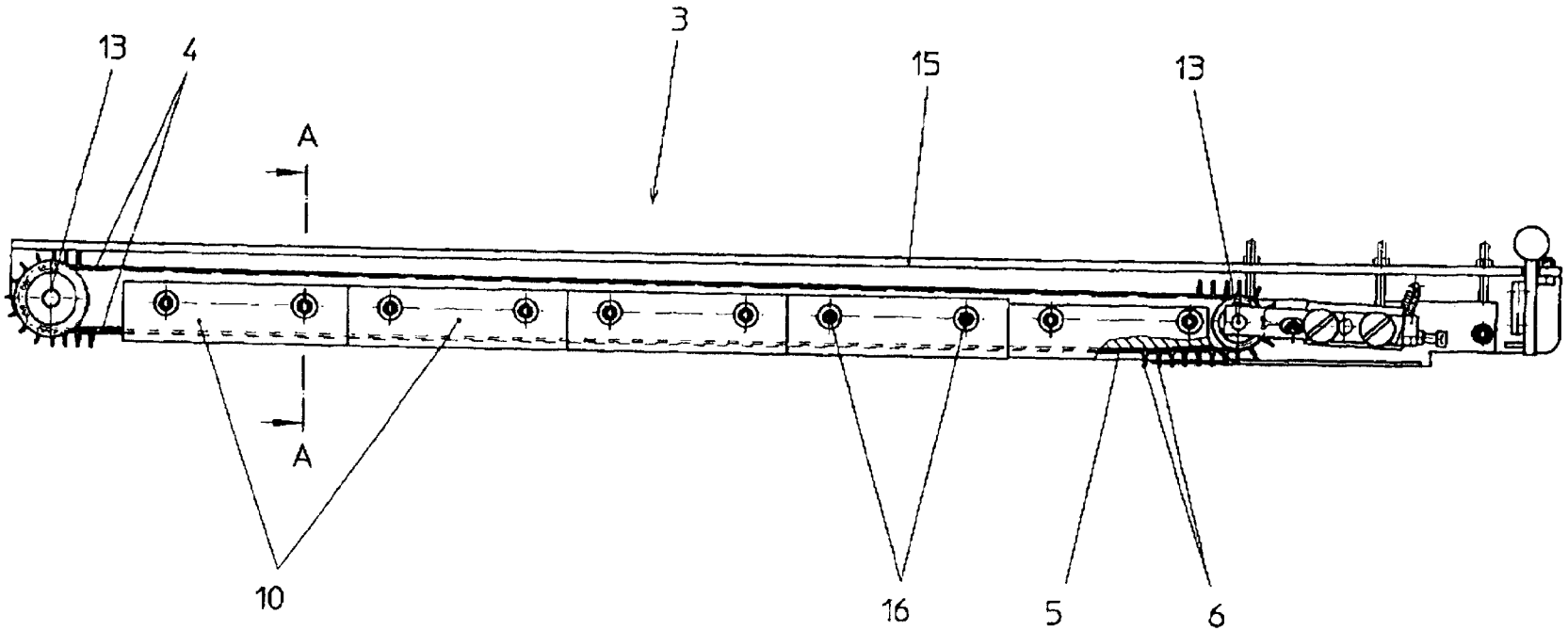
FIG. 2 is a conveying arm according to the present invention.

When viewed together with FIG. 3, FIG. 2 shows that the conveying arm 3 has a plurality of guide elements 10, which have a U-shaped cross section in the longitudinal extension of the conveying arm 3, wherein the lamella belt 4 is guided by webs 11 on both sides laterally relative to the lamella belt 4, and wherein the lamella belt 4 slides on a support surface 12 between the webs 11. As can be recognized from FIG. 2, the conveying arm 3 has deflecting rollers 13, namely, spur wheel-shaped deflecting rollers, at its end, wherein the left-hand deflecting roller 13 can be driven.

Figure 4:
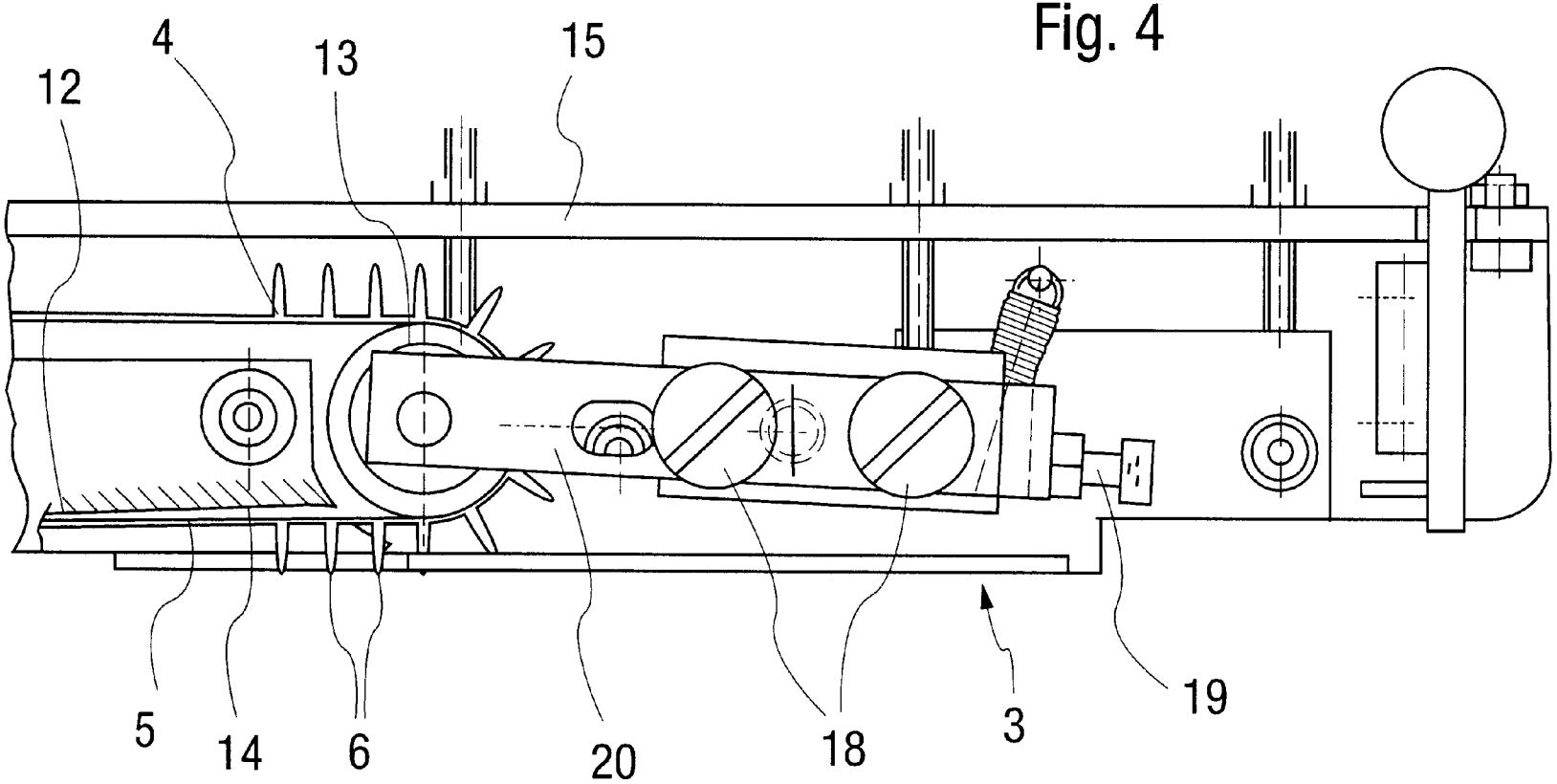
FIG. 4 is a detail view of the object according to FIG. 2.

FIG. 4 shows in detail that the support surface 12 has a wedge-shaped inlet area 14 on the inlet side of the conveying arm 3. It can be recognized here as well as in FIG. 2 that the conveying arm 3 has a base carrier 15 on which a plurality of guide elements 10 are arranged adjustably at right angles to the guideway 2. A comparative viewing of FIGS. 2 and 4 shows that the right-hand deflecting roller 13 can be adjusted and fixed in the direction of the longitudinal extension of the conveying arm 3. A roller carrier 20 is provided for this purpose, which is displaceable in relation to the base carrier 15 by means of elongated hole guides and can be adjusted by means of the adjusting screw 19 supported by a support surface that is a fixed part of the base carrier. The fixation is performed by means of the fixing screws 18.

The device according to the present invention shown in the figures is used within the framework of a device for counting and/or sorting coins 1, which is illustrated by the sorting opening 21 in the guideway 2, which is recognizable from FIG. 3.

Depending on the material pair selected, friction takes place between the lamella belt 4 and its support surface 12 located between the lateral webs 11 of the guide elements 10. Various measures, such as teflon coating, the blowing in of air, etc., are possible to minimize this friction. An intermediate belt may also be run between the lamella belt 4 and the support surface 12 and it may run together with the lamella belt 4. In the case of a lamella belt 4 with smooth back side, i.e., without teeth 8, a roller guide consisting of, e.g., needle bearing rollers, may also be used, on which the lamella belt 4 is guided like on a conveyor belt. In the case of a lamella belt 4 with V-shaped back side, it is also possible to use two lateral roller guides.

While specific embodiments of the invention have been shown and described in detail to illustrate the application of the principles of the invention, it will be understood that the invention may be embodied otherwise without departing from such principles.

What is claimed is:

1. A device for conveying separate objects, the device comprising:

a guideway;

a conveying arm;

a conveyor transport belt running on said conveying arm with a distance between a strand of said transport belt facing the guideway and said guideway being smaller than the smallest height of the objects above said guideway, wherein the objects can be grasped by said strand facing said guideway and can be conveyed on said guideway, wherein static friction and/or sliding friction forces between the objects and the strand are greater than the static friction and/or sliding friction forces between the objects and the guideway, said transport belt being a lamella belt, said strand of said lamella belt facing said guideway being guided over an entire longitudinal extension of said conveying arm along a support surface of said conveying arm with lamella tips pointing toward said guideway, said support surface being disposed relative to said guideway to define a lamella tip distance from said guideway which is smaller than the smallest height of an object above said guideway, and said support surface having a wedge-shaped inlet area on an inlet side of said conveying arm.

2. A device in accordance with claim 1, wherein the longitudinal extension of said guideway has a freely selectable angle to the horizontal direction.

3. A device in accordance with claim 2, wherein said angle between said guideway and said horizontal direction is variable and continuously variable over the course of said guideway.

4. A device in accordance with claim 1, wherein at least said lamellae of said lamella belt are formed of a material which is selected from the group consisting of elastomers, rubber, natural rubber, synthetic rubber, polyurethane, polyether polyurethane, polyester polyurethane and rubber-elastic materials.

5. A device in accordance with claim 1, wherein the height of the lamella is in the range of 2 to 20 mm.

6. A device in accordance with claim 1, wherein the lamella density is in the range of 100/100 mm to 10/100 mm.

7. A device in accordance with claim 1, wherein said lamellae have a Shore A hardness of 50 to 100.

8. A device in accordance with claim 1, wherein said lamella belt has drive teeth opposite said lamellae.

9. A device in accordance with claim 1, wherein said lamella belt has an endless steel wire insert.

10. A device in accordance with claim 1, wherein:

said conveying arm has at least one guide element, which has a U- or H-shaped cross section in the longitudinal extension of said conveying arm;

said lamella belt is guided by webs on both sides laterally relative to said lamella belt, and said lamella belt slides on said support surface between said webs.

11. A device in accordance with claim 1, wherein said conveying arm has spur wheel-shaped deflecting rollers at its end, wherein at least one of said deflecting rollers can be driven.

12. A device in accordance with claim 1, wherein said conveying arm has a base carrier, on which one or more guide elements are arranged adjustably at right angles to said guideway.

13. A device in accordance with claim 11, wherein at least one of said deflecting rollers can be adjusted in the direction of the longitudinal extension of said conveying arm and can be fixed.

14. A device in accordance with claim 1, wherein said conveying arm can be pivoted off from said guideway on one side.

15. A device in accordance with claim 1, wherein said conveying arm has at least one adjusting element for setting said lamella tip distance.

16. A device in accordance with claim 1, further comprising openings in said guideway for counting and/or sorting coins.

17. A method for conveying objects in a horizontal and/or a vertical and/or an oblique direction, the method comprising the steps of:

providing a guideway;

providing a conveying arm with a support surface spaced from said guideway and having an angled portion at a coin intake area and a transport portion;

using a conveyor transport belt running on said conveying arm with a transport region defined by said transport portion of said support surface providing a distance between a strand of said transport belt facing the guideway and said guideway that is smaller than the smallest height of the objects above said guideway and with an angled region defined by an angled portion of the guideway extending from an intake to said transport portion with said angled portion at said intake defining an intake distance from the conveyor transport belt to said guideway that is greater than a smallest height of the objects above said guideway and said angle portion defining a continuously decreasing distance from said intake distance to said transportation distance between said intake and said transport portion, said step of using the conveyor including grasping the objects with the strand facing said guideway and conveying the objects on said guideway, providing that the static friction and/or sliding friction forces between the objects and the strand are greater than the static friction and/or sliding friction forces between the objects and the guideway, providing said transport belt as a lamella belt with said strand of said lamella belt facing said guideway, guiding said lamella belt over an entire longitudinal extension of said conveying arm with said lamella tips pointing toward said guideway spaced a lamella tip distance from said guideway which is smaller than the smallest height of an object above said guideway.

18. The method in accordance with claim 17 wherein the guideway and conveyor are used with guideway openings for counting and/or sorting coins.

19. A device for conveying separate disk-shaped objects, the device comprising:

a guideway;

a conveying arm with a support surface spaced from said guideway and having an angled portion at a coin intake area and a transport portion;

a conveyor lamella belt running on said conveying arm, static friction and/or sliding friction forces between the disk-shaped objects and a strand of said lamella belt facing said guideway being greater than static friction and/or sliding friction forces between the disk-shaped objects and the guideway, said strand of said lamella belt facing said guideway being guided over said conveying arm and having lamella with lamella tips pointing toward said guideway and with the position of said support surface relative to said guideway at said transport portion defining a transportation distance from said lamella tips to said guideway which is smaller than a smallest height of the disk-shaped objects above said guideway wherein the disk-shaped objects can be grasped by said strand facing said guideway and can be conveyed on said guideway and with said angled portion extending from an intake to said transport portion with said angled portion at said intake defining an intake distance from said lamella tips to said guideway that is greater than a smallest height of the disk-shaped objects above said guideway and said angle portion defining a continuously decreasing distance from said intake distance to said transportation distance between said intake and said transport portion.

* * * * *